United States Patent [19]

MacLeod

[11] Patent Number: 4,666,346

[45] Date of Patent: May 19, 1987

[54] ROTATABLE FILL PIPE WITH COLLAPSIBLE BACKFILL ELBOW AND METHOD OF EMPLOYING SAME TO BLIND-FILL UNDERGROUND VOIDS

[75] Inventor: Kenneth H. MacLeod, Las Vegas, Nev.

[73] Assignee: Hanna-Beric Systems, Inc., Cleveland, Ohio

[21] Appl. No.: 843,011

[22] Filed: Mar. 24, 1986

[51] Int. Cl.[4] ..... E02D 7/24

[52] U.S. Cl. ..... 405/269; 406/166; 285/283; 414/139; 405/248; 405/267; 405/258

[58] Field of Search ..... 405/154, 248, 258, 266, 405/267, 269; 406/115, 164, 165, 166; 285/184, 283; 414/142, 143, 144, 139

[56] References Cited

U.S. PATENT DOCUMENTS

| | | | |
|---|---|---|---|
| 123,825 | 2/1872 | Hamilton | 285/283 |
| 537,690 | 4/1895 | Landis | 406/158 |
| 660,591 | 10/1900 | Russell | 406/158 |
| 749,737 | 1/1904 | Ley | 406/159 |
| 857,519 | 6/1907 | Foster | 285/283 |
| 941,606 | 12/1909 | Bathrick | 406/159 |
| 2,218,759 | 10/1940 | Lineman | 285/184 |
| 2,453,408 | 11/1948 | Carila | 406/165 |
| 2,542,588 | 2/1951 | Snow | 222/529 |
| 2,973,124 | 2/1961 | Reese | 222/527 |
| 3,151,720 | 10/1964 | Orr et al. | 406/162 |
| 3,175,668 | 3/1965 | Stoltzfus | 406/159 |
| 3,321,252 | 5/1967 | Dreier | 406/161 |
| 3,440,824 | 5/1969 | Doolin | 405/267 |
| 3,665,718 | 5/1972 | Griffioen et al. | 405/258 |
| 3,786,639 | 1/1974 | Pineno et al. | 405/267 |
| 3,911,954 | 10/1975 | Johnson | 285/283 |
| 4,350,467 | 9/1982 | Soros | 414/144 |
| 4,440,537 | 5/1984 | Blättermann et al. | 414/139 |
| 4,461,600 | 7/1984 | Norkus et al. | 405/269 |
| 4,557,632 | 12/1985 | Penny | 405/269 |

FOREIGN PATENT DOCUMENTS

| | | | |
|---|---|---|---|
| 1092249 | 11/1960 | Fed. Rep. of Germany | 406/161 |
| 1260416 | 8/1965 | Fed. Rep. of Germany | 406/157 |
| 2225386 | 5/1972 | Fed. Rep. of Germany | 406/160 |

*Primary Examiner*—Cornelius J. Husar
*Assistant Examiner*—Kristina I. Hall
*Attorney, Agent, or Firm*—Renner, Otto, Boisselle & Lyon

[57] ABSTRACT

Rotatable fill pipe for use in blind-filling underground voids has a collapsible backfill elbow on the lower end thereof, including an upper elbow part rigidly connected to the lower end of the fill pipe and a lower elbow part pivotally connected to the upper elbow part for pivotal movement between a lower position in coaxial alignment with the fill pipe to facilitate passage of the backfill elbow and lower end of the fill pipe through a fill hole into an underground void, and a raised position extending at an angle relative to the fill pipe to facilitate distribution of fill material introduced into the underground void through the fill pipe in a circular pile within the underground void as the fill pipe and backfill elbow are rotated about the longitudinal axis of the fill pipe. A cable may be connected to the lower elbow part for remotely actuating the lower elbow part for pivotal movement between the lower and raised positions. Also, a lower pipe extension may be provided on the lower elbow part for distributing the fill material in a larger circular pile within the underground void.

10 Claims, 4 Drawing Figures

ROTATABLE FILL PIPE WITH COLLAPSIBLE BACKFILL ELBOW AND METHOD OF EMPLOYING SAME TO BLIND-FILL UNDERGROUND VOIDS

BACKGROUND OF THE INVENTION

This invention relates generally as indicated to a rotatable fill pipe having a collapsible backfill elbow at the extreme lower end thereof, and to the method of using such fill pipe to blind-fill underground voids from the surface to prevent surface subsidence.

Heretofore, it was the usual practice to blind-fill large underground cavities, stopes, voids, mined-out areas, etc. (hereafter underground voids) by discharging hydraulic and pneumatically placed fill vertically from the surface to the bottom of the void. This had the disadvantage that the fill material formed a cone shaped pile at the bottom of the void which limited the quantity of fill that could be introduced into the void.

SUMMARY OF THE INVENTION

With the foregoing in mind, it is a principal object of this invention to provide a rotatable fill pipe for both hydraulic and pneumatically placed fill including a collapsible backfill elbow at the extreme lower end thereof for use in substantially completely blind filling underground voids from the surface.

Another object is to provide a method of blind filling underground voids from the surface utilizing such rotatable fill pipe with collapsible backfill elbow to completely fill such voids.

These and other objects of the present invention may be achieved by hingedly mounting the backfill elbow to the extreme lower end of the fill pipe at one side thereof in such a manner that the elbow can be pivoted between a lower position in coaxial alignment with the fill pipe to permit the elbow and fill pipe to be inserted down through a fill hole until the elbow enters the void, and a raised position extending at an angle (preferably 90°) relative to the fill pipe for distributing the fill material in a circular pile as the fill pipe and elbow are rotated 360° or more to fill the void. Such pivotal movement of the elbow between the lower and raised positions may be controlled by a cable suitably connected to the elbow and extending up along the exterior of the fill pipe to the surface. A rotary drilling table or support bearing may be utilized to support the vertical fill pipe column in the fill hole. The fill pipe may be secured to the surface mounted rotary table or bearing through the use of a rotary cable bushing and casing slips which grip the pipe.

To the accomplishment of the foregoing and related ends, the invention, then, comprises the features hereinafter fully described and particularly pointed out in the claims, the following description and accompanying drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
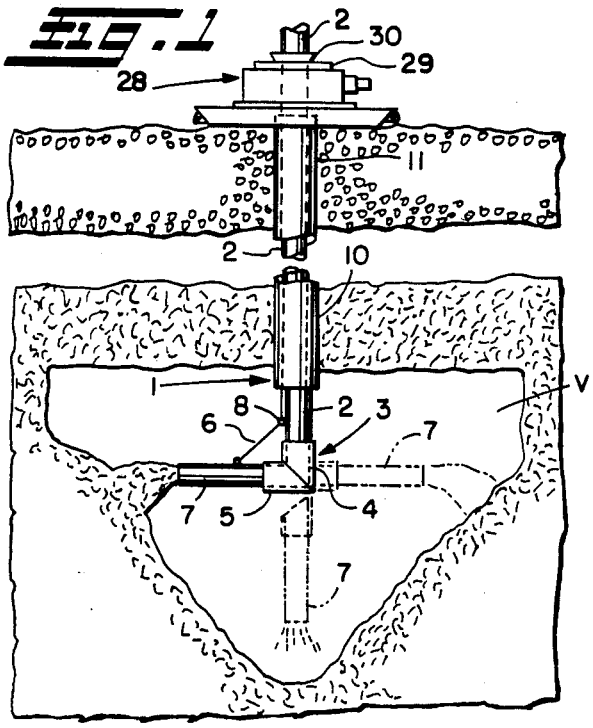
FIG. 1 is a schematic illustration of a preferred form of fill pipe with collapsible backfill elbow in accordance with this invention being used to blind-fill an underground void.
Figure 2:
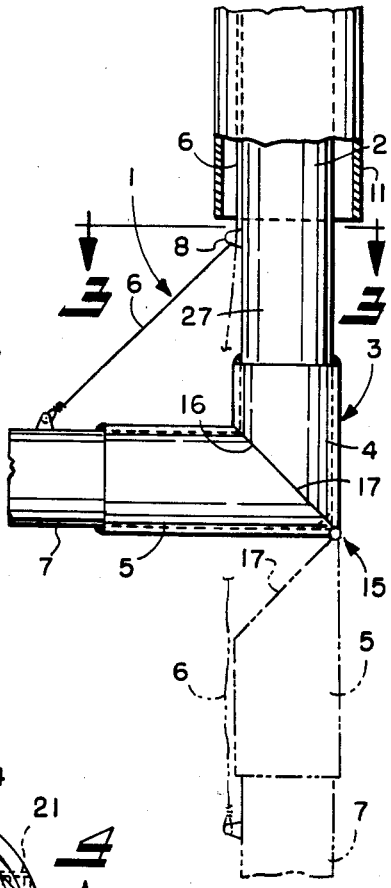
FIG. 2 is an enlarged fragmentary side elevation view of the lower end of the fill pipe and backfill elbow of FIG. 1.

Referring now in detail to the drawings, and initially to FIGS. 1 and 2, a preferred form of fill pipe assembly in accordance with this invention for both hydraulic and pneumatically placed fill is generally designated by reference numeral 1 and consists of a rotatable fill pipe 2 having a collapsible backfill elbow 3 mounted on the extreme lower end thereof. The collapsible elbow includes an upper elbow part 4 rigidly connected to the lower end of the fill pipe and a lower elbow part 5 internally hinged to the upper elbow part to permit pivotal movement of the lower elbow part relative to the upper elbow part between a lower position shown in phantom lines in FIGS. 1 and 2 in coaxial alignment with the fill pipe and a raised position shown in solid lines extending at an angle relative to the fill pipe. Movement of the lower elbow part 5 between the lower and raised positions may be controlled by a cable 6 suitably connected to the lower elbow part or pipe extension 7 thereof and extending up along the exterior of the fill pipe 2 as by providing one or more cable guides 8 along the exterior length of the fill pipe.

Initially sufficient slack is provided in the cable 6 to permit the lower elbow part 5 to pivot downwardly under its own gravitational weight to the lower position in coaxial alignment with the fill pipe as shown in phantom lines in FIGS. 1 and 2 so that the elbow can be inserted into an underground void V through a suitable fill hole 10 communicating therewith. As clearly shown in FIG. 1, the fill hole may be cased with casing pipe 11 having an inner diameter sufficiently larger than that of the fill pipe 2 and elbow 3 when the elbow is in the lower position to permit the fill pipe and elbow to freely pass therethrough. Typically, the fill pipe will be 8 inch diameter pipe and the pipe elbow 10 inch diameter pipe, in which event the casing pipe is desirably 12 inch diameter pipe. However, it should be understood that these pipe diameters will vary depending on the particular application.

As will be apparent, the cable 6 is connected to the exterior of the lower elbow part 5 or pipe extension 7 thereof on the side opposite the elbow hinge 15. Also, the lowermost cable guide 8 is desirably located closely adjacent the upper end of the upper elbow part 4 on the side of the fill pipe 2 opposite the elbow hinge. Accordingly, after the pipe elbow 3 and lowermost cable guide 8 clear the bottom of the casing pipe 11 and enter the underground void V, a tension force applied to the upper end of the cable will cause the lower elbow part 5 and pipe extension 7 to pivot upwardly about the internal hinge 15 to the raised position extending at an angle, preferably 90°, relative to the main fill pipe 2.

The angular orientation of the pipe extension 7 relative to the main fill pipe 2 when the elbow 3 is in the raised position is desirably controlled by the oppositely sloping lower and upper end faces 16 and 17 on the upper and lower elbow parts 4 and 5 which are in mating engagement with each other when the elbow is completely raised. In the preferred embodiment disclosed herein, both such surfaces 16, 17 extend in opposite directions from the hinge line at an angle of approximately 45° relative to a plane perpendicular to their respective centerlines, whereby when the pipe elbow is completely raised, the lower pipe extension 7 extends at an angle of approximately 90° relative to the main fill pipe 2. However, it will be understood that these angles can be varied somewhat so that the lower pipe extension 7 extends at an angle somewhat greater or less than 90° when the pipe elbow is completely raised as desired.

Figure 3:
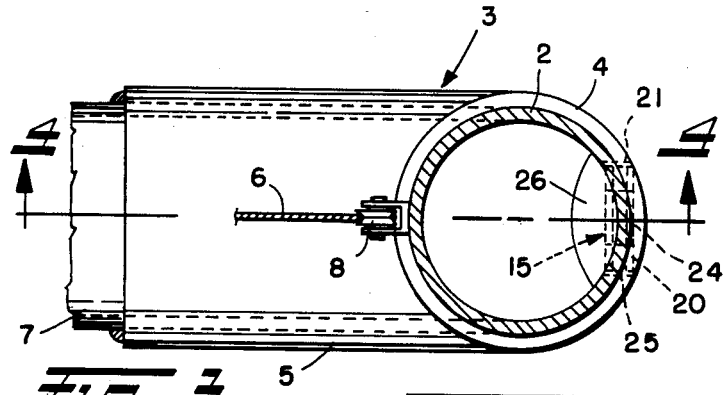
FIG. 3 is a further enlarged transverse section through the fill pipe of FIG. 2, taken along the plane of the line 3—3 thereof.
Figure 4:
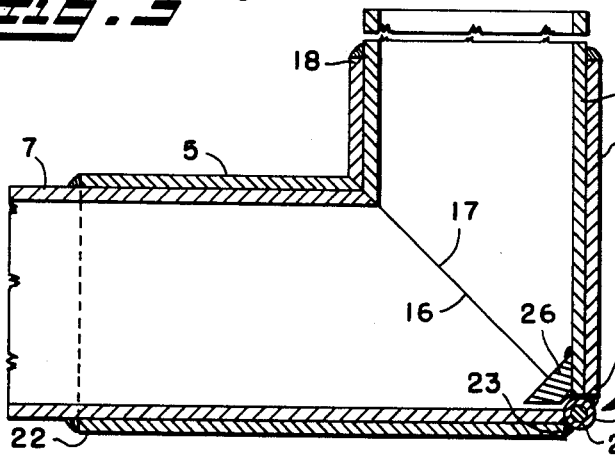
FIG. 4 is a fragmentary longitudinal section through the hinge connection between the fill pipe and backfill elbow, taken generally along the plane of the line 4—4 of FIG. 3.

The particular details of one form of pipe elbow 3 in accordance with this invention are best seen in FIGS. 3 and 4. As shown, both the lower end of the main fill pipe 2 and upper end of the lower pipe extension 7 desirably terminate at the respective lower and upper ends of the upper and lower elbow parts 4 and 5 and extend at the same respective angles. Also, the upper elbow part is desirably welded to the main fill pipe all the way around the upper end 18 thereof, and at the lowermost end 19 thereof in the region of the hinge connection 15, where two axially spaced coaxially aligned hinge barrels 20, 21 are also welded to the lower ends of the upper elbow part and main fill pipe. Similarly, the lower elbow part 5 is desirably welded to the lower pipe extension 7 all the way around the lower (outer) end 22 of the lower elbow part and at the uppermost (inner) end 23 thereof where another hinge barrel 24 is welded to the upper ends of both the lower elbow part and lower pipe extension between the first two hinge barrels 20, 21 and in coaxial alignment therewith, with a hinge pin 25 extending through all three hinge barrels. A hinge shield 26 is also desirably welded to the interior of the main fill pipe adjacent the lowermost end thereof in overlying relation to the hinge 15 to protect the hinge against damage by the fill material passing through the fill pipe assembly. The hinge shield 26 is desirably tapered as shown in FIGS. 3 and 4 so that it substantially completely covers the hinge 15 when the pipe elbow is in the raised position without obstructing in any way the movement of the lower elbow part between its fully lower and raised positions.

Although the relative lengths of the various elbow parts may vary depending on the particular application, in one embodiment of the invention, the upper elbow part 4 desirably has a maximum length of approximately 14 inches, whereas the lower elbow part 5 is substantially longer, having a maximum length of approximately 36 inches, to provide adequate support for the lower pipe extension 7 which has a maximum length of approximately 72 inches. The backfill elbow 3 may also include a separate upper fill pipe section 27 (see FIG. 2) having a maximum length, for example, of 48 inches, to provide a completely separate elbow assembly that may be welded to the bottom of a main fill pipe 2 of any desired length.

Referring further to FIG. 1, the main fill pipe 2 may be secured to a surface mounted rotary drilling table or grease lubricated hydraulic spider support bearing 28 by means of a rotary table bushing 29 and casing pipe slips 30 which grip the fill pipe. This allows the fill pipe 2 and elbow 3 to be rotated 360° or more to distribute the fill material which may either be pneumatically or hydraulically introduced into the underground void through the fill pipe, in a circular pile, for example up to 200 feet in diameter. As the underground void becomes filled, the collapsible elbow 3 can be gradually lowered and then finally moved to the full raised position and partially withdrawn from the void while continuing to introduce fill material into the void through the fill pipe to completely fill the underground void and thus prevent surface subsidence.

From the foregoing, it will now be apparent that the fill pipe assembly of the present invention with rotating, collapsible pneumatic backfill elbow maximizes the amount of fill material that can be delivered to an underground void, thereby minimizing the unsupported ground and eliminating surface subsidence.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A fill pipe assembly for use in blind-filling underground voids comprising a rotatable cylindrical fill pipe having a collapsible backfill elbow on the lower end thereof, said backfill elbow comprising an upper elbow part rigidly connected to the lower end of said fill pipe and a lower elbow part pivotally connected to said upper elbow part for pivotal movement between a lower position in coaxial alignment with said fill pipe and a raised position extending at an angle relative to said fill pipe, and actuating means for remotely actuating said backfill elbow for pivotal movement of said lower elbow part between said lower and raised positions, said upper and lower elbow parts comprising cylindrical members each of a diameter substantially equal to the diameter of said cylindrical fill pipe, said lower elbow part having a length substantially greater than the diameter of said fill pipe whereby when said lower elbow part is in the raised position, said lower elbow part extends substantially radially outwardly beyond the outer diameter of said fill pipe, and when said lower elbow part is in the lower position, said lower elbow part is in coaxial alignment with said fill pipe for ease of insertion of said fill pipe through a fill hole into an underground void prior to remotely actuating said backfill elbow for pivotal movement of said lower elbow part within such void from said lower position to said raised position.

2. The fill pipe assembly of claim 1, wherein said lower elbow part includes a lower pipe extension thereon for pivotal movement with said lower elbow part.

3. The fill pipe assembly of claim 1, wherein said upper and lower elbow parts are hinged together by a hinge along one side, and said actuating means comprises a cable connected to said lower elbow part on the side opposite said hinge, and there are guide means for said cable on the side of said fill pipe opposite said hinge, said guide means being located closely adjacent the upper end of said upper elbow part, said cable extending around said guide means and up along the exterior length of said fill pipe to the upper end thereof where a tension force may be applied thereto to cause said lower elbow part to pivot from said lower position to said raised position.

4. The fill pipe assembly of claim 3 further comprising a hinge shield internally mounted within said upper elbow part, said hinge shield extending downwardly within said upper elbow part in overlying relation to said hinge to protect said hinge against damage by fill material passing through said fill pipe assembly and backfill elbow.

5. The fill pipe assembly of claim 3, wherein the lower end of said upper elbow part and the upper end of said lower elbow part have oppositely sloping faces which are adapted to be brought into mating engagement with each other when said backfill elbow is in the fully raised position.

6. The fill pipe assembly of claim 5, wherein said oppositely sloping faces extend in opposite directions from said hinge at an angle of approximately 45° relative to a plane perpendicular to the respective centerlines of said upper and lower elbow parts, whereby when said backfill elbow is in the fully raised position, said lower elbow part extends at an angle of approximately 90° relative to said fill pipe.

7. The fill pipe assembly of claim 6 further comprising a lower pipe extension on said lower elbow part, the lower end of said fill pipe and the upper end of said lower pipe extension extending into the respective upper and lower elbow parts and terminating at the lower and upper ends thereof at the same respective angles.

8. The fill pipe assembly of claim 1 further comprising means for rotating said fill pipe and backfill elbow about the longitudinal axis of said fill pipe after the lower end of said fill pipe and said backfill elbow have been inserted through a fill hole into an underground void while said lower elbow part was in the lower position, and after said lower elbow part has been moved to a raised position to permit fill material to be pneumatically or hydraulically introduced into the underground void through said fill pipe and backfill elbow for distribution of the fill material in a circular pile within the underground void.

9. The fill pipe assembly of claim 8 further comprising a lower pipe extension on said lower elbow part for passage of the fill material therethrough and discharge therefrom into the underground void.

10. The fill pipe assembly of claim 2, wherein said pipe extension has a length substantially greater than said lower elbow part and extends into said lower elbow part substantially the full length of said lower elbow part to provide adequate support for said extension within said lower elbow part.

* * * * *